United States Patent [19]

Sekiguchi et al.

[11] Patent Number: 4,469,506

[45] Date of Patent: Sep. 4, 1984

[54] PRODUCTION PROCESS OF FERROMAGNETIC IRON POWDER

[75] Inventors: Haruo Sekiguchi, Chigasaki; Kimiteru Tagawa, Kawasaki; Kazushi Ohshima; Nobuhiro Fukuda, both of Yokohama, all of Japan

[73] Assignee: Mitsui Toatsu Chemicals, Incorporated, Tokyo, Japan

[21] Appl. No.: 460,381

[22] Filed: Jan. 24, 1983

[51] Int. Cl.[3] ..... C22C 1/04

[52] U.S. Cl. ..... 75/0.5 AA; 75/0.5 BA; 148/105

[58] Field of Search ..... 75/0.5 BA, 0.5 AA; 148/105; 252/62.56

[56] References Cited

U.S. PATENT DOCUMENTS 4,165,232 8/1979 Jaeckl et al. ..... 75/0.5 BA
4,290,799 9/1981 Schroeder et al. ..... 75/0.5 AA

FOREIGN PATENT DOCUMENTS 42832 12/1979 Japan ..... 75/0.5 AA

*Primary Examiner*—L. Dewayne Rutledge
*Assistant Examiner*—Debbie Yee
*Attorney, Agent, or Firm*—Fisher, Christen & Sabol

[57] ABSTRACT

Disclosed herein is a process for producing ferromagnetic iron powder, which process comprises adding and mixing boron oxide or a borate with $\alpha$-FeOOH or $\alpha$-$Fe_2O_3$ without dissolving the former, heating the thus-obtained mixture to 350° C. or higher in a non-reducing atmosphere and then reducing the thus-heated mixture.

7 Claims, 2 Drawing Figures

PRODUCTION PROCESS OF FERROMAGNETIC IRON POWDER

BACKGROUND OF THE INVENTION

1. Field of the Invention

This invention relates to a process for producing ferromagnetic iron powder which has utility for high-density magnetic recording media such as magnetic tapes, magnetic drums and magnetic discs.

2. Description of the Prior Art

It has heretofore been known that ferromagnetic iron powder can be produced by heating and reducing an oxyhydroxide or oxide such as acicular $\alpha$-FeOOH or $\alpha$-$Fe_2O_3$ (hereinafter abbreviated as "acicular goethite or the like"). However, such a conventional process is inevitably accompanied by breakup, fragmentation and sintering of the raw material, goethite or the like upon heating and reducing same. As an improvement to the above-described prior art process, it has been proposed in Japanese patent publication No. 42832/1979 to obtain ferromagnetic metal powder by dipping its corresponding oxide or oxyhydroxide in an aqueous solution containing boron oxide or a borate dissolved therein and then heating and reducing the thus-dipped oxide or oxyhydroxide.

When the latter process is followed, a great deal of energy is required because a large volume of water, which contains boron oxide or borate, has to be removed by evaporation. Furthermore, the boron oxide or borate dissolved in water tends to move together with water toward the evaporation interface upon driving off the solvent and the concentration distribution of boron oxide or the borate within the resulting powder becomes unavoidably uneven, leading to another disadvantage that the powder has to be heated and reduced while being of uneven concentration distribution. As a result, the magnetic properties of the thus-obtained powder deteriorate.

The above-described phenomenon that boron oxide or the borate moves to the evaporation interface upon the removal of the solvent by evaporation will be described in further detail. The concentration of boron oxide or the borate in a surface layer increases due to, for example, the movement of a filter layer to the surface phase, the movement of filter cake onto the surfaces of lumps or the like, thereby deleteriously affecting the uniformity of the ferromagnetic iron powder to be obtained.

SUMMARY OF THE INVENTION

An object of this invention is to provide ferromagnetic iron powder having utility for high-density magnetic recording media such as magnetic tapes, magnetic drums, magnetic discs and the like.

Another object of this invention is to provide ferromagnetic iron powder having uniform quality and such magnetic properties as high coersive force (Hc).

The above objects have been achieved by a process for producing ferromagnetic iron powder by heating a metal oxyhydroxide or oxide containing iron as its principal metallic element in a reducing atmosphere so as to reduce said oxyhydroxide or oxide, which process comprises the following consecutive steps:

mixing said oxyhydroxide or oxide with boron oxide and/or one or more borates at a B/Fe atomic weight ratio of 0.05/100–5/100 without dissolving said boron oxide or borates, so that said boron oxide or borates are dispersed in said oxyhydroxide or oxide;

heating the thus-obtained mixture to 350° C. or higher in a non-reducing atmosphere; and heating and reducing the thus-heated mixture while keeping same in contact with hydrogen gas.

DESCRIPTION OF PREFERRED EMBODIMENTS

Figure 1:
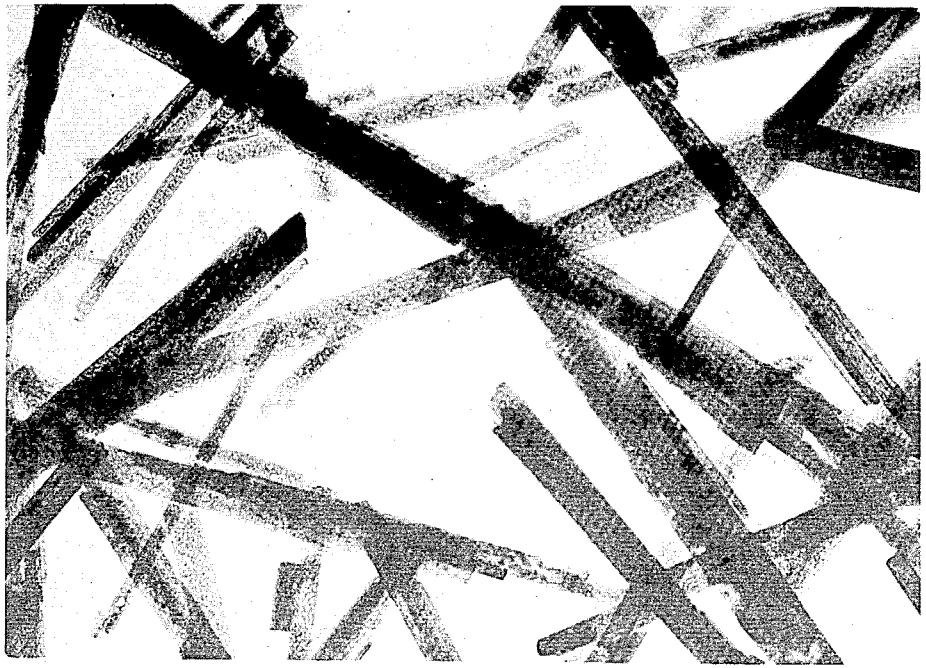
FIG. 1 is a transmission electron micrograph (×100,000) of $\alpha$-FeOOH treated with boron oxide and then subjected to a heating step.

In the practice of the process according to this invention, it is possible to use a metal oxyhydroxide or oxide containing iron as its principal metallic element and obtained in a manner commonly known in the art without any further treatment or processing. Accordingly, a mechanical mixing method may be applied to mix and disperse, for example, acicular goethite or the like and boron oxide or a borate, using such an ordinary mixer as will be described later in this specification.

Thus, boron oxide and/or the borate is mixed with and dispersed in acicular goethite or the like without need for dissolving the former in a solvent or the like and, in some instances, by mixing them together in solid forms. It is however feasible to employ a small amount of a dispersing medium, e.g., water or the like since the present invention makes use of boron oxide or a specifically selected borate which has little solubility, particularly, in water. When using a dispersing medium as mentioned above, it is preferable to employ as the dispersing medium such a medium that either does not dissolve boron oxide and the borates or has extremely low dissolving power of less than 1 wt. % for them because, although the dispersing medium may be separated from boron oxide or the borate by filtration or evaporation as mentioned above, boron oxide or the borate may move together with the dispersing medium to the filtrate side and/or the concentration distribution of boron oxide or the borate may be rendered uneven upon causing the dispersing medium to evaporate if the dispersing medium should have high dissolving power.

Exemplary borates particularly useful in the practice of this invention include aluminum borate, nickel borate, copper borate, cobalt borate and manganese borate. It should however be borne in mind that the effects of the present invention will not be adversely affected by the co-presence of other elements such as Si, P and Cr and/or the same elements in other forms such as Al, Ni, Mn and Cu compounds other than their borates. Boron oxide or the borate may be added at a boron/iron atomic weight ratio (hereinafter abbreviated as "B/Fe ratio") of 0.05/100–5/100, and preferably 0.2/100–2/100. No distinct effects can be brought about when the B/Fe ratio is less than 0.05/100. On the other hand, at any B/Fe ratios higher than 5/100, iron is diluted by boron oxide or the borate, resulting in deteriorated magnetic properties. Use of such a high B/Fe ratio is also inconvenient because it requires an excessively long time to complete the subsequent reducing step. Although the ferromagnetic iron powder obtained in accordance with this invention is diluted due to the incorporation of boron and other elements therein, it consists principally of iron and contains iron, preferably, at a proportion of 90 wt. % or more.

The mixing of the metal oxyhydroxide or oxide with boron oxide or the borate or, in some instances, their mixing and dispersion in the presence of a dispersing medium may be effected mechanically, for example, using a mixer such as a mixing blender, e.g., ribbon blender, mix-muller, roll mixer, or ball mill. When mixing and dispersing them in, for example, a ribbon blender, the mixing and dispersing operation can be effected to a sufficient extent generally in 5 minutes to 10 hours, and more generally in 5 minutes to 6 hours or so at room temperature. It is also feasible in the present invention to drive off the dispersing medium in the course of such a mixing and dispersing operation. Here, the mixing and dispersing operation may be carried out under reduced pressures and/or at elevated temperatures of about 100° C.

The acicular goethite or the like containing boron oxide or the borate mixed and dispersed therein is then heated for 30 minutes to 4 hours, at temperatures of 350° C. and higher, preferably at 350°–500° C. and in a non-reducing atmosphere, for example, in air or nitrogen gas. Owing to this heating operation, the oxyhydroxide ($\alpha$-FeOOH) is converted to the oxide ($\alpha$-$Fe_2O_3$) and, at the same time, boron oxide or the borate is rendered compatible with the acicular goethite or the like. In other words, it is gathered that the deposition of boron oxide or the borate into pores present in particle surfaces of the goethite is carried out efficiently by mixing the acicular goethite or the like with boron oxide or the borate and then heating the resultant mixture to 350° C. or higher. Although it has not yet been elucidated why such an efficient deposition takes place, it has been recognized, as shown in the accompanying drawings, that the number of pores in an oxide decreases to a significant extent when heated in accordance with the present invention.

The process next move to the reducing step, in which $H_2$ gas or a gaseous mixture containing $H_2$ gas is caused to act on the goethite or the like at 200°–450° C., and preferably at 350°–400° C. A suitable supply rate of $H_2$ gas to the goethite or the like may be in the range of 0.1–100 Nl/gr-Fe/hr, preferably 2–50 Nl/gr-Fe/hr as expressed in terms of gas space velocity (GHSV). Below the lower limit, the progress of the reaction is too slow to actually carry it out. On the other hands, any supply rates of $H_2$ gas greater than the upper limit result in an increment in pressure loss within the reactor and are thus not suitable for the control of the reaction.

Furthermore, outside the above-described reaction temperature range, more specifically, at temperatures lower than the lower limit of the reaction temperature range, the reaction proceeds at a slow speed and takes a longer time to bring the reaction to completion. Use of such low reaction temperatures is thus not practical. On the other hand, use of a reaction temperature higher than the above-described reaction temperature range tends to induce the sintering of acicular goethite or the like.

One of merits of the present invention is that this has made it possible to lower the reducing temperature. According to prior art processes, it was difficult to obtain satisfactory magnetic properties when the reducing temperature was lowered. However, when the present invention is followed, satisfactory magnetic properties are observed even if the reducing temperature is lowered to 350° C.–400° C. A high power electron microscopic observation accordingly indicates that iron powder obtained in accordance with this invention still retains almost completely the shape of goethite or the like, which was used as the starting material, and is substantially free of such phenomena as particle breakup and fragmentation and intergranular sintering. Superb magnetic properties of the thus-obtained iron powder are readily realized, because, taking—by way of illustration—coersive force (Hc) which may vary to some extents in accordance with the sizes and length/-width ratios of particles, the Hc value of iron powder obtained by reducing goethite or the like at 375° C. in the presence of, for example, boron oxide is 1240 (Oe), namely, this value is extremely high. Such superb magnetic properties meet the property requirements for materials to be used in the fabrication of high-density magnetic recording media. This has been substantiated by the magnetic properties of the substance after it has been formed into magnetic tapes. Accordingly, ferromagnetic iron powder according to this invention has an extremely high practical value.

The present invention will hereinafter be described more specifically in the following Examples.

EXAMPLE 1

In the present example, B/Fe=0.5/100.

To 200 g of acicular $\alpha$-FeOOH, 2 g of boron oxide (as $B_2O_3$) were added. The resultant mixture was mixed for 30 minutes in a mixing blender so as to disperse boron oxide in $\alpha$-FeOOH. The resultant mixture was then placed in a heating furnace and heated for 2 hours at 500°±5° C. in an air atmosphere. It was then allowed to cool and drawn out of the heating furnace. A high power transmission electron microscopic observation on the thus-heated mixture showed $\alpha$-$Fe_2O_3$ bearing less pores (see, FIG. 1). Upon comparing the above observation with a similar high power electron microscopic observation on a corresponding heat-treated mixture obtained in Comparative Example 1 which will be described later in this specification, it was confirmed that boron oxide had already been rendered compatible with $\alpha$-$Fe_2O_3$ in the course of the heat treatment. The heating step had now been completed. The process then moved to the reducing step. One hundred grams of the $\alpha$-$Fe_2O_3$ obtained in the above heating step were charged in a reactor having an inner diameter of 38 mm, made of stainless steel and provided with a reaction gas preheater. $H_2$ gas was then introduced at a supply rate of GHSV=20 Nl-$H_2$/gr-Fe/hr. The $\alpha$-$Fe_2O_3$ was subjected to reduction at 375° C. for 6 hours. After the reduction, the interior gas of the reactor was replaced by $N_2$ gas and, subsequent to cooling the reaction product, the thus-reduced iron powder was taken out of the reactor and immersed in toluene. A portion of the iron powder was spread in an enameled plate so as to allow toluene to evaporate. Magnetic properties of the resultant iron powder (hereinafter called "wind-dried iron powder"), from which toluene had been removed by its evaporation, were measured. The measurement gave coersive force (Hc)=1240 Oe; saturated magnetization ($\sigma$s)=163 emu/gr, and squareness ratio($\sigma$r/$\sigma$s)=0.56. Therefore, it was found that the iron powder has very good magnetic properties.

COMPARATIVE EXAMPLE 1

Figure 2:
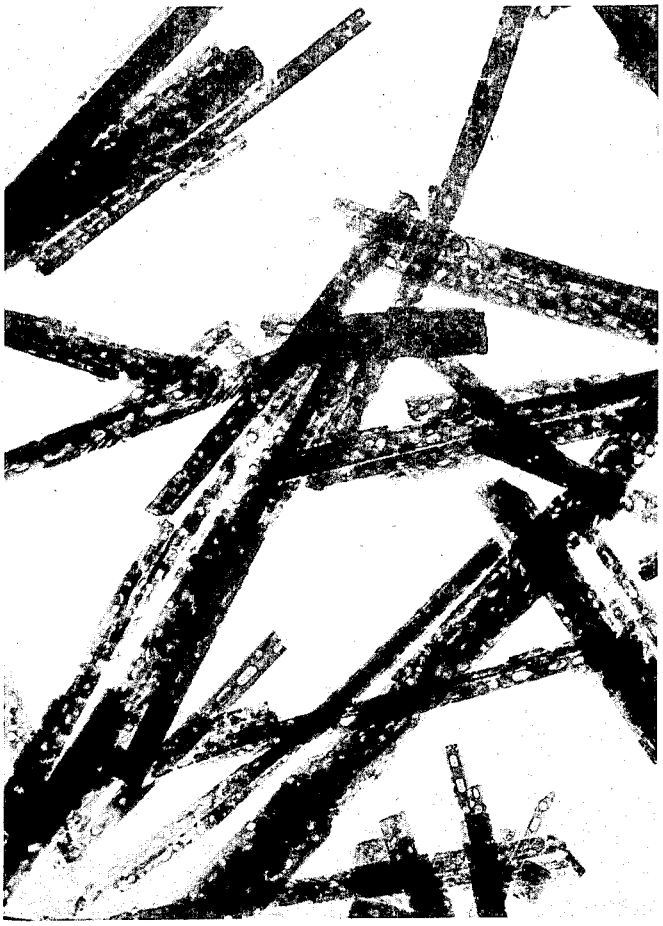
FIG. 2 is a transmission electron micrograph (×100,000) of $\alpha$-FeOOH subjected to a heating step without pretreating same with boron oxide.

$\alpha$-FeOOH was subjected to a heat-treatment under the same conditions as in Example 1 except that no boron oxide was added. A similar transmission electron microscopic observation showed $\alpha$-$Fe_2O_3$ bearing less pores (see, FIG. 2). The thus-obtained $\alpha$-$Fe_2O_3$, to which boron oxide had not been added, was reduced to iron under the same reducing conditions as in Example 1 and the magnetic properties of the resultant iron powder were found to be Hc=540 Oe; $\sigma s$=176 emu/gr; and $\sigma r/\sigma s$=0.31. Thus, its magnetic properties had greatly decreased in comparison with those of iron powder obtained in accordance with this invention. As a result of a high power electron microscopic observation on the iron powder obtained in each of Example 1 and Comparative Example 1, it was found that the iron powder according to this invention still retained acicular crystallinity even after being reduced into iron powder whereas the iron powder obtained in Comparative Example 1, which was given for the sake of comparison, was in a sintered state and no longer retained the acicular crystallinity of its starting $\alpha$-FeOOH. Incidentally, the measurements of the above magnetic properties were effected in a magnetic field of 3.7 KOe at the maximum, using a dc-type magnetic hysteresis analyzer.

COMPARATIVE EXAMPLE 2

Added to 200 gr of acicular $\alpha$-FeOOH used in Example 1 were 625 gr of an aqueous solution of 1 wt. % of ammonium borate, said mixture was mixed for 30 minutes in a mixing blender (calculated as B/F=0.5/100). The thus-prepared mixture was spread in a layer about 3 cm thick in a heating furnace and heated for 2 hours at 500° C. in the same manner as described in Example 1. It was then allowed to cool and drawn out. Where the B/F content ratio of $\alpha$-$Fe_2O_3$ present in the upper part of the above layer in a heating furnace was calculated as 1, that of lower part was calculated as 0.71. Then the resulting heated mixture was reduced and its magnetic properties were measured in the same manner as described in Example 1. The magnetic properties of the resulting iron powder were Hc=1040–1210 Oe; $\sigma s$=150–170 emu/gr; and $\sigma r/\sigma s$=0.45–0.52, and it is recognized that it had scattered magnetic properties according to its position in the heating furnace. Namely, where water soluble borates are added to acicular goethite or the like, scattering of magnetic properties occurs and the resulting iron powder is unsuitable for use in magnetic recording media.

EXAMPLE 2

In the present example, a B/Fe ratio of 0.2/100 was employed and the heating conditions were set at 400° C. and 2 hours. Other conditions were the same as those employed in Example 1. Namely, 0.4 g of boron oxide was added to 100 g of acicular $\alpha$-FeOOH and the thus-formed mixture was mixed for 30 minutes in a mixing blender, thereby dispersing boron oxide in $\alpha$-FeOOH. The resultant mixture was then placed in a heating furnace and heated at 400°±5° C., for 2 hours and in an atmosphere of air. Thereafter, the thus-heated mixture was taken out of the furnace.

Fifty grams of $\alpha$-$Fe_2O_3$, which had been obtained in the above heating step, were reduced in the same reactor as that used in Example 1. Measurements of magnetic properties of the thus-obtained iron powder gave Hc=1130 Oe; $\sigma s$=159 emu/gr; and $\sigma r/\sigma s$=0.54. It had satisfactory properties as a high-density magnetic recording material.

EXAMPLE 3

In the present example, the B/Fe ratio was set at 2/100 and the heating conditions of 500° C. and 2 hours were employed. Added to 100 g of acicular $\alpha$-FeOOH was 4.0 g of boron oxide, followed by mixing the thus-proportioned mixture for 1 hour in a mix-muller. The resultant mixture was then placed in a heating furnace and heated at 500° C.±5° C., for 2 hours and in an atmosphere of air. The thus-heated mixture was drawn out of the furnace. Fifty grams of $\alpha$-$Fe_2O_3$, which had been obtained in the above heating step, were placed in the same reactor as that employed in Example 1. $H_2$ gas was charged at a supply rate of GHSV=Nl-$H_2$/gr-Fe/hr. The magnetic properties of iron powder wind-dried following the procedure of Example 1 were Hc=1190 Oe; $\sigma s$=156 emu/gr; and $\sigma r/\sigma s$=0.55. The iron powder obtained in the present example showed very little deterioration in magnetic properties with the passage of time.

EXAMPLES 4–8

Magnetic properties of the iron powders obtained respectively by using the starting materials and reaction conditions shown in Table 1 were found as also given in the same table. Reaction conditions other than those given in Table 1 were set in the same manner as employed in Example 1.

TABLE 1

| | | Example | | | | |
|---|---|---|---|---|---|---|
| | | 4 | 5 | 6 | 7 | 8 |
| Starting | $\alpha$-FeOOH (gr) | 100 | 100 | 100 | — | — |
| Iron | $\alpha$-$Fe_2O_3$ (gr) | — | — | — | 100 | 100 |
| Material | | | | | | |
| Boron oxide (gr) | | — | — | 1.0 | — | 1.1 |
| (B/Fe ratio) | | (0) | (0) | (0.25/100) | (0) | (0.25/100) |
| Borate (gr) | | Aluminum borate | Nickel borate | Copper borate | Cobalt borate | Manganese borate |
| (B/Fe ratio) | | 2.5 (0.5/100) | 2.1 (0.5/100) | 1.6 (0.25/100) | 2.3 (0.5/100) | 2.9 (0.25/100) |
| Dispersing medium (gr) | | — | Isopropanol (900) | Water of low electric conductivity (900) | — | Water of low electric conductivity (900) |
| Heating temp. (°C.) | | 400 | 450 | 500 | 400 | 500 |
| Heating time (hr) | | 2 | 2 | 2 | 4 | 1 |
| Reducing temp. (°C.) | | 420 | 375 | 400 | 350 | 450 |
| Reducing time (hr) | | 4 | 6 | 5 | 8 | 3 |
| Magnetic | Hc (Oe) | 1150 | 1200 | 1150 | 1210 | 1120 |
| proper- | $\sigma s$ (emu/gr) | 154 | 157 | 153 | 158 | 154 |

TABLE 1-continued

| | | Example | | | | |
|---|---|---|---|---|---|---|
| | | 4 | 5 | 6 | 7 | 8 |
| ties | $\sigma r/\sigma s$ | 0.55 | 0.56 | 0.55 | 0.57 | 0.54 |

As shown by the above Examples, the present invention provides an excellent material suitable for use as a high-density magnetic recording medium, which material has a coersive force exceeding 1100 Oe, a saturated magnetization of more than 150 emu/gr and a squareness ratio of 0.54–0.57.

EXAMPLE 9

Twenty-five grams of the magnetic iron powder obtained in Example 1 were placed together with 10 gr of a 25% methyl ethyl ketone solution of thermoplastic polyurethane resin, 38 gr of methyl ethyl ketone and 0.05 gr of a silicon-base additive in a vessel made of stainless steel. Using alumina-made beads as a dispersing medium, the above-proportioned mixture was treated for 8 hours by means of a paint conditioner so as to form a mill base. The mill base was further added with 10 gr of the above-mentioned methyl ethyl ketone solution of the polyurethane resin. Its viscosity was thereafter adjusted by an addition of methyl ethyl ketone, thereby obtaining a magnetic coating formulation. This magnetic coating formulation was applied onto a reinforced polyethylene terephthalate film of 12 $\mu$m thickness by means of a blade coater to give a dry coat thickness of about 4 $\mu$m and the magnetic particles were oriented by passing the thus-coated film through a magnetic field. Thereafter, the thus-applied coating layer was dried with hot air and the resultant magnetic tape was passed through calender rolls, thereby obtaining a sample magnetic tape for evaluation. Measurements of magnetic properties of the above tape gave good results, namely, Hc=1210 Oe, Br/Bs=0.80 and orientation=2.0. The high Br/Bs ratio and high orientation indicate that the initial acicular crystallinity has been retained until reduced to iron and the thus-prepared magnetic powder is excellent in dispersability.

What is claimed is:

1. Process for producing ferromagnetic iron powder by heating a metal oxyhydroxide or oxide containing iron as its principal metallic element in a reducing atmosphere so as to reduce said metal oxyhydroxide or oxide, comprising the following consecutive steps:

(a) mixing said metal oxyhydroxide or oxide with boron oxide, one or more borates or a mixture thereof at a B/Fe atomic weight ratio of 0.05/100 to 5/100 without dissolving said boron oxide or borates, so that said boron oxide or borates are dispersed in said metal oxyhydroxide or oxide;

(b) heating the mixture obtained from steps (a) to a temperature of from 350° to 500° C. in a non-reducing atmosphere; and (c) reducing the heated mixture from step (b) at a temperature of from 200° to 450° C. while keeping said heated mixture in contact with hydrogen gas.

2. The process as claimed in claim 1 wherein said metal oxyhydroxide or oxide is acicular $\alpha$-FeOOH or $\alpha$-$Fe_2O_3$.

3. The process as claimed in claim 1 wherein said borates include aluminum borate, nickel borate, cobalt borate and manganese borate.

4. The process as claimed in claim 1 wherein mixing and dispersing step (a) is carried out in the absence of any dispersing medium.

5. The process as claimed in claim 1 wherein mixing and dispersing step (a) is carried out in the presence of a dispersing medium.

6. The process as claimed in claim 5 wherein the solubility of said boron oxide or one or more borates in said dispersing medium is 1 weight percent or lower.

7. The process as claimed in claim 1 wherein the B/Fe atomic weight ratio is between 0.2/100 and 2/100.

* * * * *